US007862403B2

(12) United States Patent
Lai

(10) Patent No.: US 7,862,403 B2
(45) Date of Patent: Jan. 4, 2011

(54) SURFACE GRINDER FOR BALL OF BALL VALVE

(76) Inventor: Chun Chen Lai, No. 16, Suyu St., Dali City, Taichung County (TW)

( * ) Notice: Subject to any disclaimer, the term of this patent is extended or adjusted under 35 U.S.C. 154(b) by 0 days.

(21) Appl. No.: 12/150,360

(22) Filed: Apr. 28, 2008

(65) Prior Publication Data

US 2009/0098811 A1 Apr. 16, 2009

(30) Foreign Application Priority Data

Oct. 12, 2007 (TW) ..... 96217062 U

(51) Int. Cl.
*B23B 7/00* (2006.01)

(52) U.S. Cl. ..... 451/11; 451/268; 451/548

(58) Field of Classification Search ..... 451/50, 451/121, 543, 548, 268
See application file for complete search history.

(56) References Cited

U.S. PATENT DOCUMENTS

| | | | | | |
|---|---|---|---|---|---|
| 1,806,918 | A * | 5/1931 | Riggs | 451/115 |
| 1,989,215 | A * | 1/1935 | Seybold | 451/548 |
| 2,082,404 | A * | 6/1937 | Leshure | 451/548 |
| 3,300,905 | A * | 1/1967 | Gardner | 451/121 |
| 3,716,951 | A * | 2/1973 | Walters | 451/548 |
| 3,818,644 | A * | 6/1974 | Walters | 451/342 |
| 3,961,448 | A * | 6/1976 | Akahane | 451/268 |
| 3,971,164 | A * | 7/1976 | Albin et al. | 451/283 |
| 6,402,600 | B1 * | 6/2002 | Besch | 451/268 |
| 7,220,171 | B1 * | 5/2007 | Riel | 451/50 |

* cited by examiner

*Primary Examiner*—Maurina Rachuba
(74) *Attorney, Agent, or Firm*—Charles E. Baxley

(57) ABSTRACT

A surface grinder for a ball of a ball valve comprises a ball positioning device at an X axis for driving the ball to rotate about the X axis and a grinding device at a Z axis for driving a grindstone set to rotate about the Z axis, wherein the grindstone set grinds a spherical surface of the ball.

8 Claims, 5 Drawing Sheets

SURFACE GRINDER FOR BALL OF BALL VALVE

BACKGROUND OF THE INVENTION

1. Technical Field

The present invention relates to balls of ball valves, and more particularly, to a machine for grinding a spherical surface of a ball of a ball valve.

2. Description of Related Art

A ball of a ball valve is a spherical structure having a central flow channel and a grinding process is typically applied to a surface of the spherical structure to endow the same with a necessary surface smoothness. It is known that such grinding process can be performed with a belt sander by positioning a ball at a rotating shaft that rotates the ball and grinding a spherical surface of the ball with a high-speed running sand belt. However, when implemented to treat the spherical surface of the ball, the conventional belt sander having a physically planar grinding surface is incapable of ensuring a roundness of the ball. In addition, during the grinding process, relative displacement between the sand belt and the ball tends to form disordered grinding traces on the surface of the ball.

Besides, while the aforementioned grinding process is subject to professionals' manual operation, grinding dust generated during the grinding process can adversely affect the environment and the operators' health. Moreover, with a lack of a reliable way to ensure the roundness of the spherical structure of the ball, an accuracy of the roundness is confined to 20 μm, resulting in a limitation in the qualitative perfection of the ground balls.

SUMMARY OF THE INVENTION

The primary objective of the present invention is to remedy the problems of imperfect roundness and disordered grinding traces on the surface of the ball that are caused by grinding the ball with a belt sander.

To achieve this objective, the disclosed surface grinder for a ball of a ball valve comprises:

a ball positioning device, assembled along a horizontal axis (an X axis) of the grinder for positioning and rotating the ball; and a grinding device, materialized by a grindstone set, assembled along a vertical axis (a Z axis) of the grinder to be rotated by a power source and having a plurality of grindstones arranged into a circular pattern, wherein each said grindstone has a concave grinding surface and all the grinding surfaces jointly form a concave grinding portion;

whereby when rotated by the ball positioning device, the ball receives an grind at an overall spherical surface thereof.

The ball positioning device at the X axis drives the ball to perform a rotation about the X axis while the grinding device at the Z axis drives the grindstone set perform a rotation about the Z axis. Consequently, a cooperation of the mutually perpendicular rotations ensures a roundness of the spherical surface of the ball and present fine, even and ordered grinding lines on the surface of the ball.

The ball positioning device of the present invention comprises a ball positioning shaft for receiving a ball mounted thereon. The ball positioning shaft includes an inner bush having a taper shape assembled inside an outer bush so as to control an outward expanding angle of the outer bush and hold balls with different sizes thereon.

The grindstone set of the present invention can be installed with grindstones having grinding surfaces of different sizes so as to meet a need of surface grind for balls of different sizes.

The grinder of the present invention is a full automatic apparatus that eliminates a need of manual grinding operation so that balls having a roundness of at least 5 μm can be produced without a need of professionals' manual operation. While the disclosed grinder contributes to reliably ensure an accuracy of grind, it also eliminates grinding dust that affects the environment and human health by applying a grinding liquid during the grinding process.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein.

DETAILED DESCRIPTION OF THE PREFERRED EMBODIMENT

While a preferred embodiment is provided herein for illustrating the concept of the present invention as described above, it is to be understood that the components in these drawings are made for better explanation and need not to be made in scale.

Figure 1:
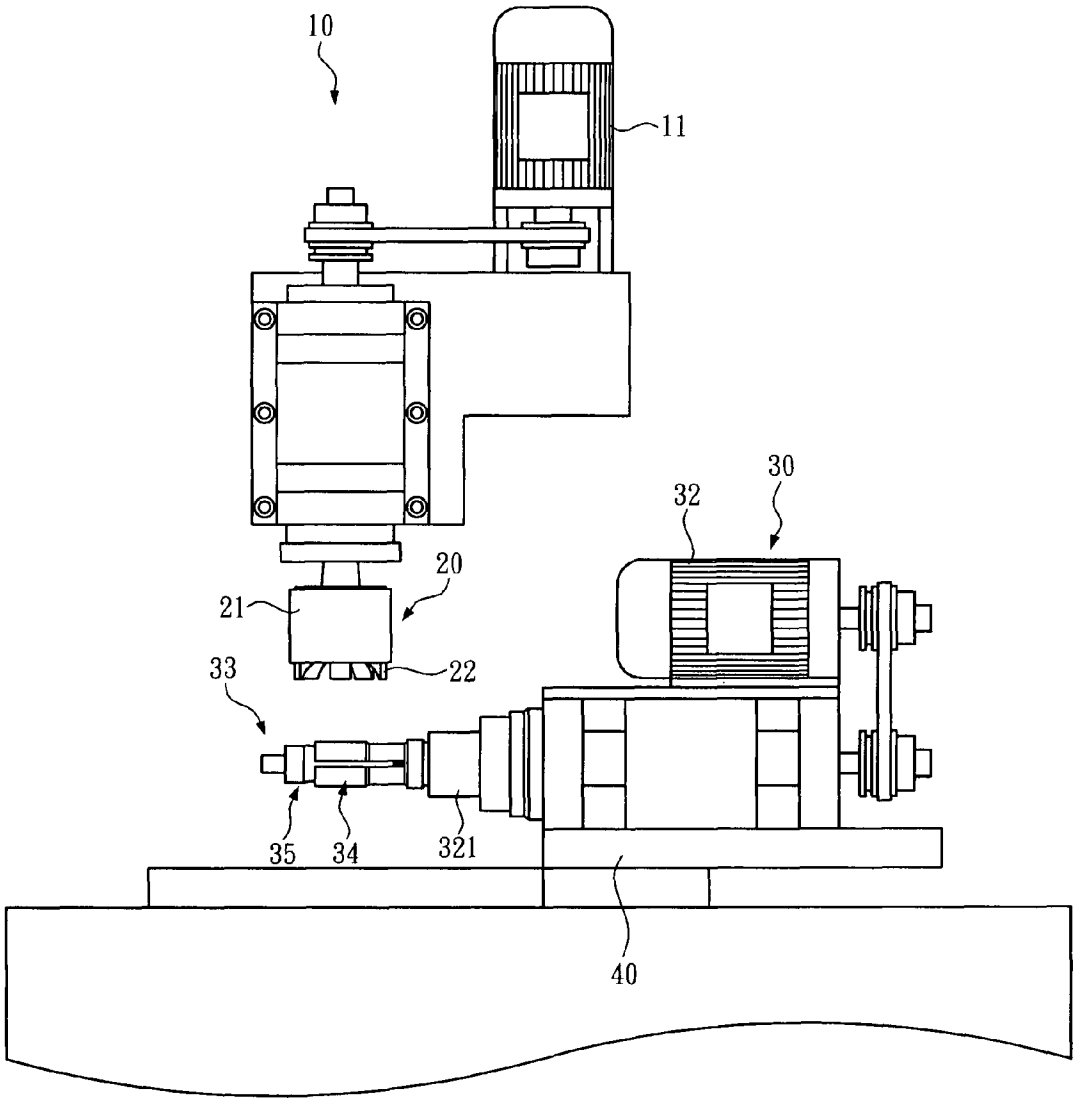
FIG. 1 is a lateral view of a grinder of the present invention.
Figure 3:
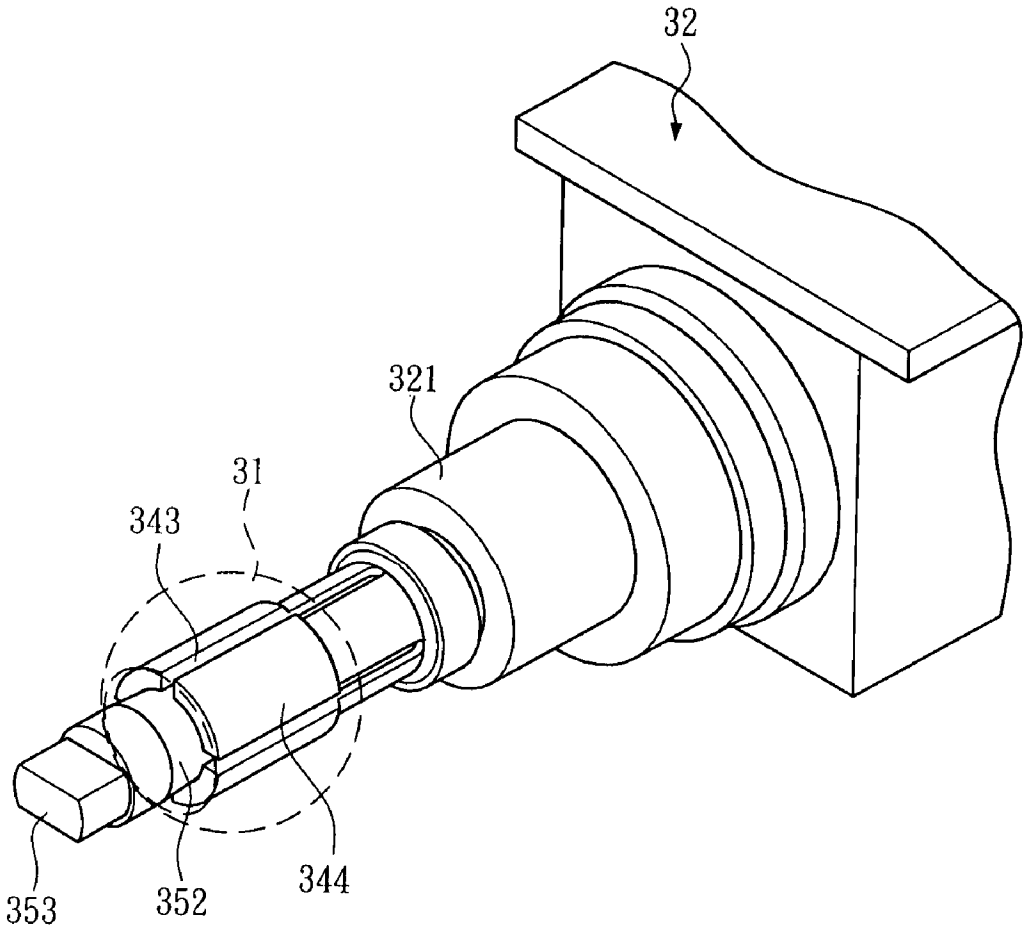
FIG. 3 is an assembled view of the ball positioning shaft of the grinder of the present invention.

In FIG. 1, a grinder for balls of ball valves of the present invention comprises a grinding device 10 assembled along a vertical axis (a Z axis) of the grinder and a ball positioning device 30 assembled along a horizontal axis (an X axis) of the grinder. The ball positioning device 30 serves to position and rotate a ball 31 (as shown in FIG. 3). The grinding device 10 grinds a surface of the ball 31 with a grindstone set 20 that rotates in a high speed. The ball positioning device 30 is settled on a platform 40 that is fine adjustable so as to be adjusted to make a center of the ball 31 align with an axis of the grindstone set 20.

Figure 2:
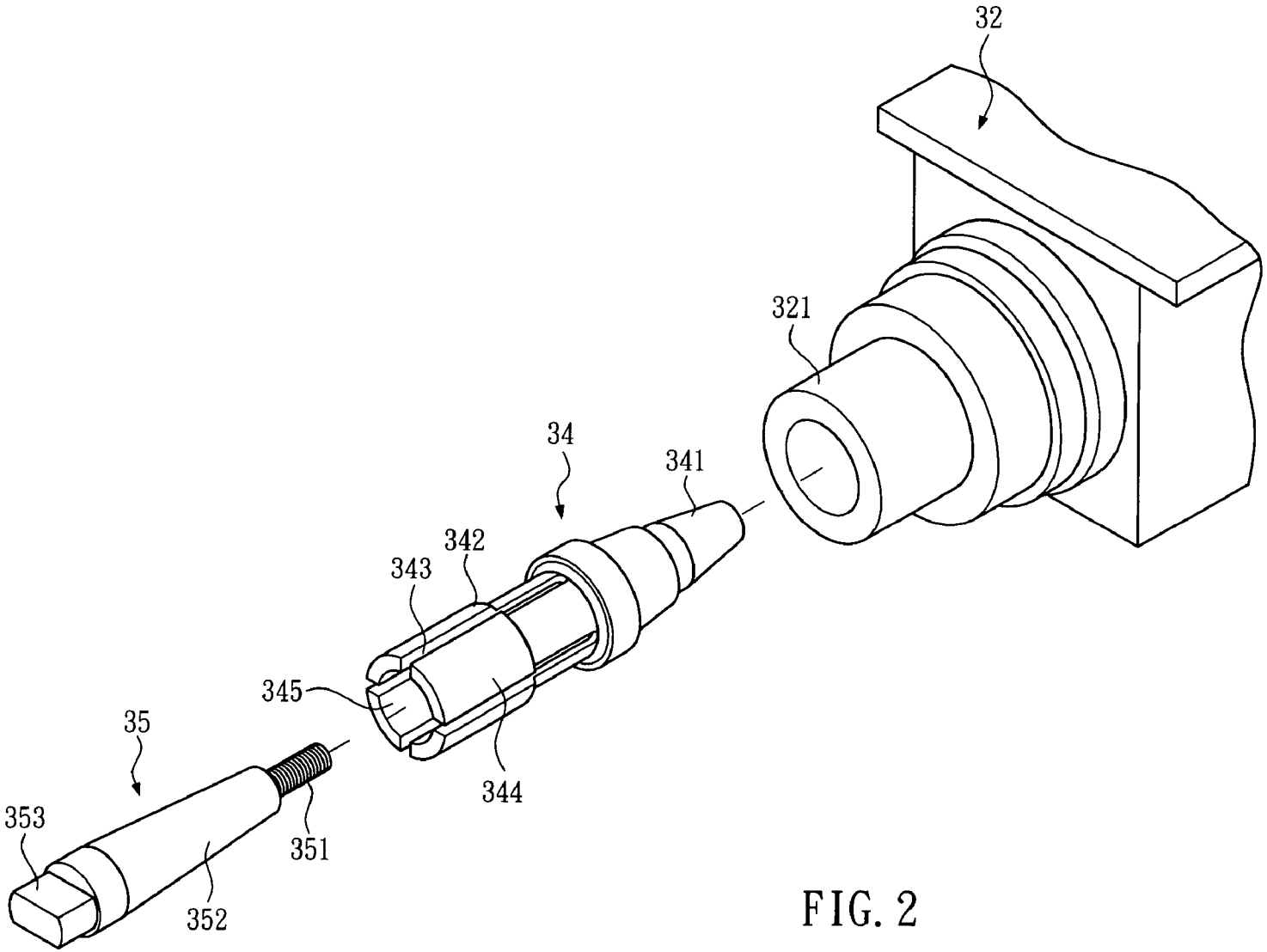
FIG. 2 is an exploded view of a ball positioning shaft of the grinder of the present invention.

Referring to FIGS. 1, 2 and 3, the ball positioning device 30 comprises a power source 32 and a ball positioning shaft 33, wherein the ball positioning shaft 33 is rotated by the power source 32. The positioning shaft 33 includes an outer bush 34 and an inner bush 35. The outer bush 34 contains a fixing portion 341 and a claw portion 342 that are coaxially formed as an integral. The fixing portion 341 is a taper shaft for passing through and being settled in a driving shaft 321 of the power source 32. The claw portion 342 is a hollow tube that includes a plurality slits 343 provided on a peripheral wall thereof so as to form claws 344 that can constrict toward an axis of the outer bush 34. The claw portion 342 further has an opening 345 formed at an end opposite to an end where the fixing portion 341 is attached. The inner bush 35 comprises a fixing portion 351, a taper shaft 352 and a driven portion 353 that are coaxially formed as an integral. The inner bush 35 pierces into the outer bush 34 through the opening 345. The fixing portion 351 is fixed inside the outer bush 34 by means of a combination of a screw rod and a threaded hole. The taper shaft 352 is positioned inside the claw portion 342 and expands the claws 344 outward for a predetermined extent taper shaft 352 on the strength of its taper shape. The driven portion 353 allows a tool or a hand to exert a force thereon so as to driven the inner bush 35 to rotate and then make the screw shaft screw and be assembled into the threaded hole.

Figure 6:
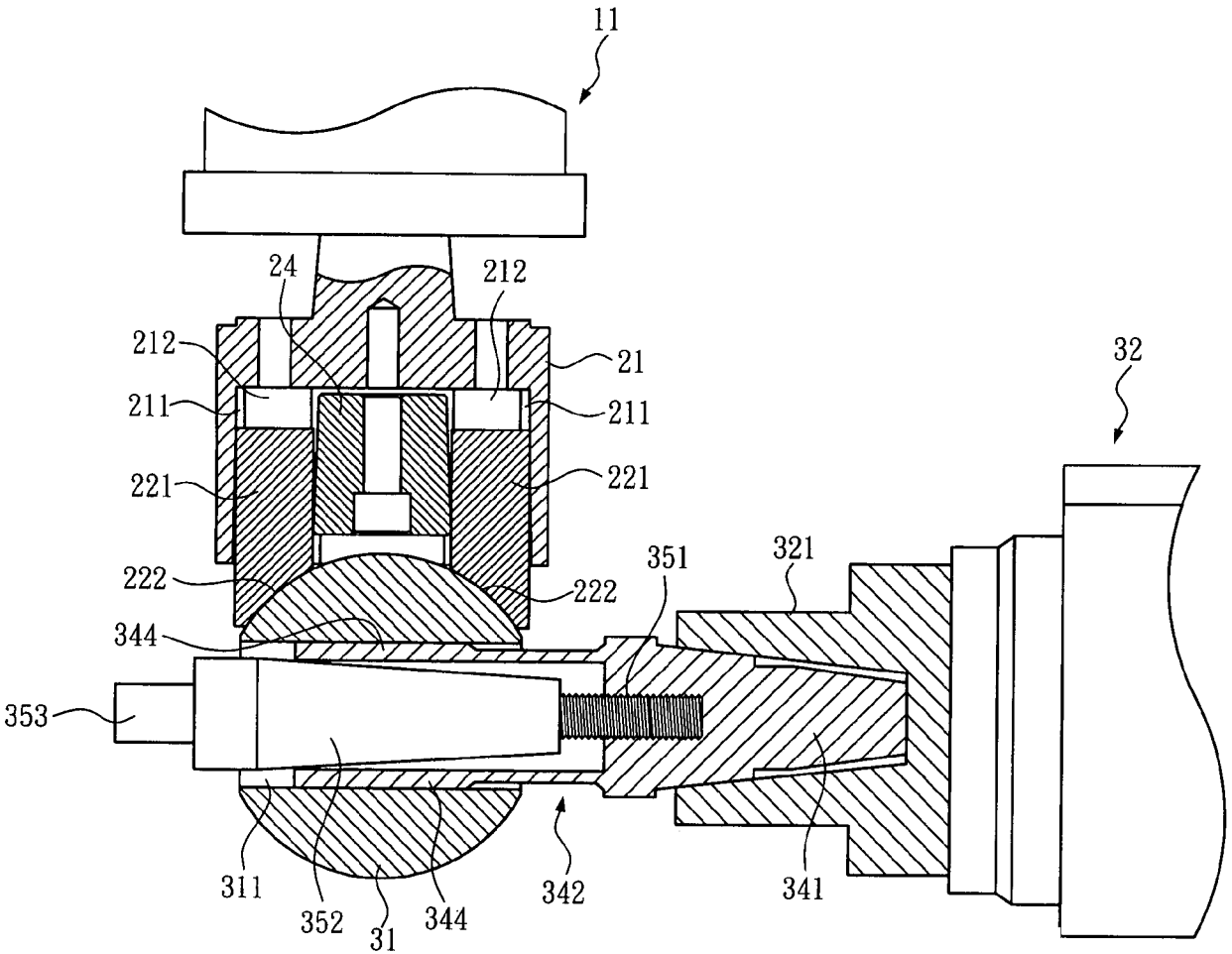
FIG. 6 is an applied drawing showing the grinder of the present invention grinding a ball.

As can be seen in FIG. 6, after an axial flow channel 311 of the ball 31 is mounted around an exterior of the outer bush 34, the inner bush 35 can be placed into the outer bush 34 to expand the claw portion 342 to closely fit an inner wall of the axial flow channel 311 so that the ball 31 can be retained on the ball positioning shaft 33 and be rotated by the power source 32 of the ball positioning shaft 33.

Figure 4:
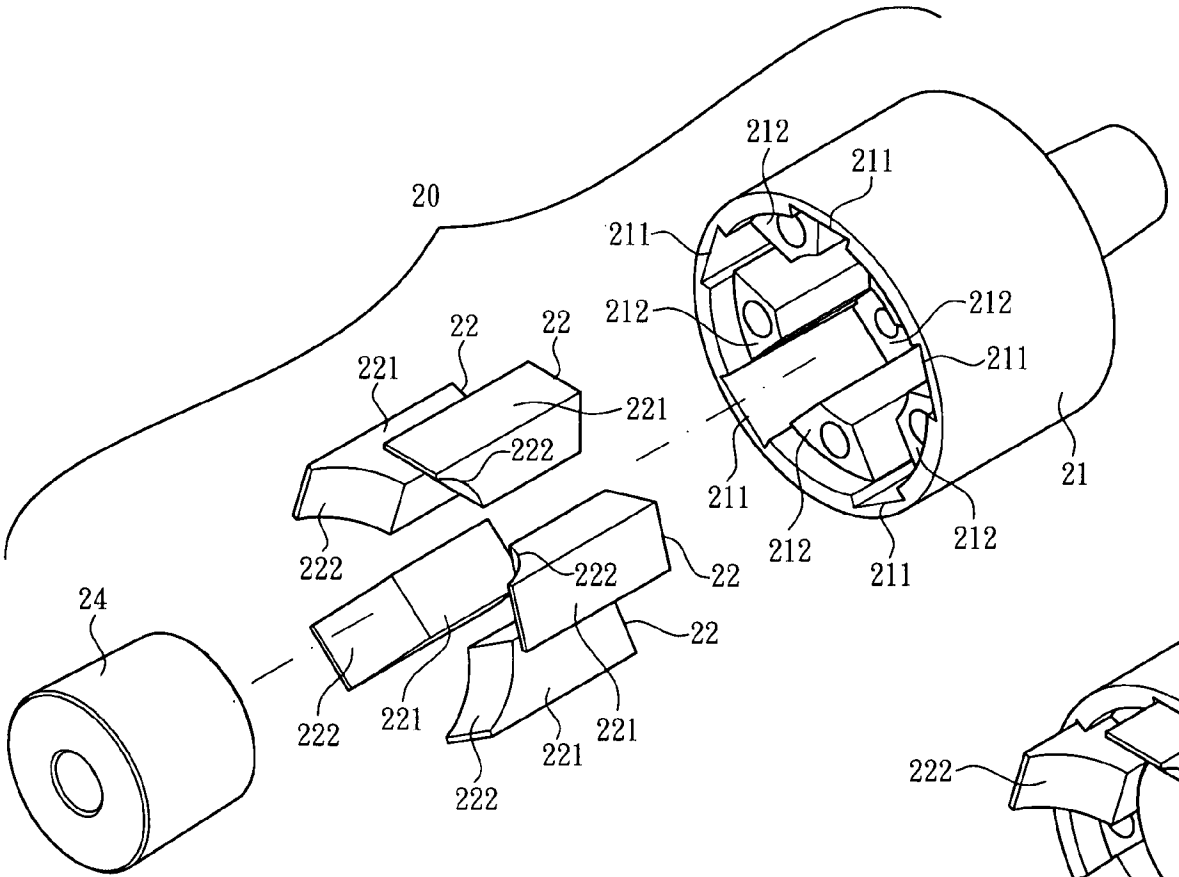
FIG. 4 is an exploded view of a grindstone set of the grinder of the present invention.
Figure 5:
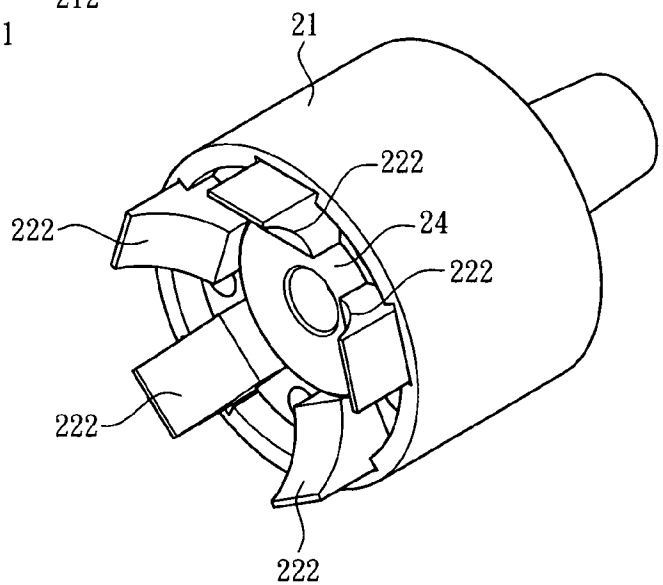
FIG. 5 is an assembled view of the grindstone set of the grinder of the present invention.

According to FIGS. 1, 4 and 5, the grinding device 10 comprises a power source 11 and the grindstone set 20, wherein the grindstone set 20 is rotated by the power source 11. The grindstone set 20 comprises a grindstone seat 21 for carrying grindstones. The grindstone seat 21 is inside provided with a plurality of recesses 211 peripherally arranged and spacers 212 settled between each two said adjacent recesses 211. A plurality of said grindstones 22 each having a non-cylindrical positioning portion 221 and a concave grinding surface 222 formed at an end of the grindstone 22. The positioning portion 221 is settled inside the recess 211 and retained between the spaces 212. The grinding surfaces 222 of the grindstones 22 jointly define a concave grinding surface. A taper positioning block 24 is settled at a center of the grindstone seat 21 and connected to a driving shaft (not shown) of the power source 11 of the grinding device 10 for pressing the grindstones 22 and positioning the same in the recess 211. The positioning block 24 may be fixed to the grindstone seat 21 or connected to the driving shaft of the power source 11 in any conventional means.

In FIG. 6, the concave grinding portion accommodates a part of the spherical surface of the ball 31 that is positioned on the ball positioning shaft 33 so that the grinding surfaces 222 of the grindstones 22 contact the spherical surface of the ball 31. Then, when the ball positioning shaft 33 drives the ball 31 to rotate, and the grindstone set 20 also rotates, the surface of the ball 31 receives an grind at an overall spherical surface thereof.

The ball positioning device 30 at the X axis drives the ball 31 to rotate about the X axis while the grinding device 10 at the Z axis drives the grindstone set 20 to rotate about the Z axis. Consequently, a cross effect of the rotations can ensure a roundness of the spherical surface of the ball 31 and present fine, even and ordered grinding lines on the surface of the ball 31.

The ball positioning device 30 of the present invention uses the taper shape of the ball positioning shaft 352 to control the expanding extent of the claw portion 342 so as to fix balls of different sizes on the ball positioning shaft 33. Besides, the grindstones 22 can be such preformed that the grinding surfaces of various radians and area can be provided so that a user can assemble the grindstones 22 according to his/her needs of grinds.

Although the particular embodiment of the invention has been described in detail for purposes of illustration, it will be understood by one of ordinary skill in the art that numerous variations will be possible to the disclosed embodiments without going outside the scope of the invention as disclosed in the claims.

What is claimed is:

1. A surface grinder, which serves to grind a ball of a ball valve and comprises:

a single horizontal axis;

a single vertical axis;

a ball positioning device, assembled along said horizontal axis of the grinder for positioning and rotating the ball; and a grindstone set, assembled along said vertical axis of the grinder and having a plurality of grindstones arranged in an circular pattern, wherein each said grindstone has a concave grinding surface and all the grinding surfaces jointly define a semi-spherical concave grinding space, in which said grindstone set is rotated by a power source so as to use the grinding surfaces to grind a spherical surface of the ball wherein, the ball positioning device comprises a power source and a ball positioning shaft, in which the power source rotates the ball positioning shaft and the ball is mounted around an exterior of the ball positioning shaft at an axial flow channel of the ball and wherein, the ball positioning shaft comprises an outer bush and an inner bush, in which the outer bush is fixed to a driving shaft of the power source and has a claw portion constricts toward an axis of the outer bush while the ball is mounted around an exterior of the claw portion at the axial flow channel of the ball and the inner bush has a taper shaft settled in the claw portion so as to expand the claw portion outward in order to close fit the axial flow channel.

2. The surface grinder as claimed in claim 1 wherein, the outer bush further comprises a fixing portion connected to one end of the claw portion for linking with the power source.

3. The surface grinder as claimed in claim 2, wherein, the claw portion is a hollow tube that includes a plurality slits provided on a peripheral wall thereof so as to form claws that can constrict toward the axis of the outer bush and has an opening formed at an end opposite to the end where the fixing portion is attached.

4. The surface grinder as claimed in claim 1 wherein, the inner bush further comprises a fixing portion connected to one end of the shaft for being fixed inside the outer bush.

5. The surface grinder as claimed in claim 4, wherein, the inner bush and the outer bush are combined mutually by means of a screw rod and a threaded hole.

6. The surface grinder as claimed in claim 5, wherein, the inner bush further comprises a fixing portion connected to another end of the shaft.

7. The surface grinder as claimed in claim 1 wherein, the ball positioning device is settled on a platform that is fine adjustable.

8. The surface grinder as claimed in claim 1 wherein, the grindstone set comprises a grindstone seat that is inside provided with a plurality of recesses peripherally arranged, and spacers settled between each two said adjacent recesses, so that after the grindstones are settled in the recesses, a positioning block is settled at a center of the grindstone seat for pressingly positioning the grindstones in the recess.

* * * * *